US012239891B2

(12) United States Patent
Westrum et al.

(10) Patent No.: US 12,239,891 B2
(45) **Date of Patent: *Mar. 4, 2025**

(54) GOLF CLUB HEAD COMPRISING MICROSCOPIC BUBBLE MATERIAL

(71) Applicant: Topgolf Callaway Brands Corp., Carlsbad, CA (US)

(72) Inventors: Joshua D. Westrum, San Diego, CA (US); Hong G. Jeon, Seoul (KR); Scott Manwaring, Carlsbad, CA (US); Kenneth E. Meacham, Hemet, CA (US); Brooks Roche, Ramona, CA (US)

(73) Assignee: Topgolf Callaway Brands Corp., Carlsbad, CA (US)

( * ) Notice: Subject to any disclaimer, the term of this patent is extended or adjusted under 35 U.S.C. 154(b) by 11 days.

This patent is subject to a terminal disclaimer.

(21) Appl. No.: 18/374,214

(22) Filed: Sep. 28, 2023

(65) Prior Publication Data

US 2024/0017136 A1 Jan. 18, 2024

Related U.S. Application Data

(60) Continuation of application No. 17/399,260, filed on Aug. 11, 2021, now Pat. No. 11,771,966, which is a continuation of application No. 16/996,038, filed on Aug. 18, 2020, now Pat. No. 11,090,534, which is a continuation of application No. 16/540,917, filed on Aug. 14, 2019, now Pat. No. 10,744,379, which is a continuation-in-part of application No. 16/241,859, filed on Jan. 7, 2019, now Pat. No. 10,653,930, which is a continuation of application No. 15/927,917, filed on Mar. 21, 2018, now Pat. No. 10,173,108, which is a continuation-in-part of application No. 15/807,851, (Continued)

(51) Int. Cl.
*A63B 53/04* (2015.01)
*A63B 60/00* (2015.01)

(52) U.S. Cl.
CPC ..... *A63B 53/0475* (2013.01); *A63B 60/00* (2015.10); *A63B 60/002* (2020.08); *A63B 2209/00* (2013.01)

(58) Field of Classification Search
CPC ..... A63B 53/0466; A63B 53/047; A63B 2053/0479; A63B 2053/0483; A63B 53/0416; A63B 53/0425; A63B 53/0429
USPC ..... 473/350
See application file for complete search history.

(56) References Cited

U.S. PATENT DOCUMENTS 4,650,626 A * 3/1987 Kurokawa ..... B29C 70/72 264/328.5
4,824,110 A * 4/1989 Kobayashi ..... A63B 60/00 473/347

(Continued)

*Primary Examiner* — Alvin A Hunter
(74) *Attorney, Agent, or Firm* — Michael A. Catania

(57) ABSTRACT

A golf club head with a face component having a variable thickness and a coating on a rear surface of the face component that provides a flat surface to which a medallion can be affixed, and methods of manufacturing such golf club heads, are disclosed herein. The coating is made from a fill material comprising a polymer and a plurality of microscopic bubbles, which preferably constitute 5-70% of the volume of the fill material. The polymer material preferably is a polyurethane having a Poisson's ratio of 0.40-0.50.

12 Claims, 13 Drawing Sheets

Related U.S. Application Data filed on Nov. 9, 2017, now Pat. No. 10,052,535, which is a continuation-in-part of application No. 15/718,285, filed on Sep. 28, 2017, now Pat. No. 10,039,964, which is a division of application No. 15/665,004, filed on Jul. 31, 2017, now Pat. No. 9,808,685.

(60) Provisional application No. 62/457,086, filed on Feb. 9, 2017.

(56) References Cited

U.S. PATENT DOCUMENTS 5,007,643 A * 4/1991 Okumoto ..... B29C 70/66 273/DIG. 7
5,465,969 A * 11/1995 Cadorniga ..... A63B 53/04 473/346
5,507,985 A * 4/1996 Cadorniga ..... A63B 60/00 264/45.3
6,533,679 B1 * 3/2003 McCabe ..... A63B 60/02 473/335
6,835,144 B2 * 12/2004 Best ..... A63B 53/047 473/332
8,206,239 B2 * 6/2012 Gilbert ..... A63B 53/047 473/331
8,535,176 B2 * 9/2013 Bazzel ..... A63B 53/047 473/290
8,777,776 B2 * 7/2014 Wahl ..... A63B 53/047 473/345
9,808,685 B1 * 11/2017 Westrum ..... A63B 53/047
10,039,964 B1 * 8/2018 Westrum ..... A63B 53/047
10,052,535 B1 * 8/2018 Westrum ..... A63B 60/00
10,173,108 B2 * 1/2019 Westrum ..... A63B 53/047
10,653,930 B2 * 5/2020 Westrum ..... A63B 53/0475
10,744,379 B2 * 8/2020 Westrum ..... A63B 53/0475
11,090,534 B2 * 8/2021 Westrum ..... A63B 53/0475
2008/0058117 A1 * 3/2008 Roach ..... A63B 53/047 473/332
2018/0221725 A1 * 8/2018 Westrum ..... A63B 53/04
2018/0221726 A1 * 8/2018 Westrum ..... A63B 60/00
2019/0255399 A1 * 8/2019 Westrum ..... A63B 53/047
2019/0366170 A1 * 12/2019 Westrum ..... A63B 53/0475
2020/0376352 A1 * 12/2020 Westrum ..... A63B 60/00
2021/0370146 A1 * 12/2021 Westrum ..... A63B 60/00
2023/0001273 A1 * 1/2023 Kaplan ..... A63B 53/0487

* cited by examiner

GOLF CLUB HEAD COMPRISING MICROSCOPIC BUBBLE MATERIAL

CROSS REFERENCES TO RELATED APPLICATIONS

The present application is a continuation application of U.S. patent application Ser. No. 17/399,260, filed on Aug. 11, 2021, which is a continuation of U.S. patent application Ser. No. 16/996,038, filed on Aug. 18, 2020, and issued on Aug. 17, 2021, as U.S. patent Ser. No. 11/090,534, which is a continuation of U.S. patent application Ser. No. 16/540,917, filed on Aug. 14, 2019, and issued on Aug. 18, 2020, as U.S. patent Ser. No. 10/744,379, which is a continuation-in-part of U.S. patent application Ser. No. 16/241,859, filed on Jan. 7, 2019, and issued on May 19, 2020, as U.S. patent Ser. No. 10/653,930, which is a continuation of U.S. patent application Ser. No. 15/927,917, filed on Mar. 21, 2018, and issued on Jan. 8, 2019, as U.S. patent Ser. No. 10/173,108, which is a continuation-in-part of U.S. patent application Ser. No. 15/807,851, filed on Nov. 8, 2017, and issued on Aug. 21, 2018, as U.S. patent Ser. No. 10/052,535, which is a continuation-in-part of U.S. patent application Ser. No. 15/718,285, filed on Sep. 28, 2017, and issued on Aug. 7, 2018, as U.S. patent Ser. No. 10/039,964, which is a division of U.S. patent application Ser. No. 15/665,004, filed on Jul. 31, 2017, and issued on Nov. 7, 2017, as U.S. Pat. No. 9,808,685, which claims priority to U.S. Provisional Patent Application No. 62/457,086, filed on Feb. 9, 2017, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head. More specifically, the present invention relates to a golf club head comprising a novel polymeric material that coats at least a portion of a rear surface of the striking face, which improves the sound of the club head without significantly reducing the golf club head's ball speed or coefficient of restitution.

Description of the Related Art

Golf club heads, and particularly iron-type golf club heads, often include polymeric materials disposed behind the striking face to improve or dampen the sound of the head upon impact with a golf ball. For example, U.S. Pat. No. 5,492,327 discloses an iron with a damping material in a recess, U.S. Pat. No. 6,743,117 discloses a dampening insert behind a strike face insert in an iron, and U.S. Pat. No. 9,168,437 discloses an elastomeric insert attached to the back of the striking face of an iron. Unfortunately, while a polymer fill or insert can improve the sound of the golf club in which it is disposed, this configuration reduces ballspeed off the face, as well as the coefficient of restitution (COR) of the golf club head. This occurs because polymers such as urethane are rigid, with a Poisson's ratio of around 0.5, and when a polymer fills a cavity or space, the polymer prevents the golf club face from flexing. Therefore, there is a need for a golf club head comprising an improved damping material that also preserves, or otherwise optimizes, ballspeed and COR values.

BRIEF SUMMARY OF THE INVENTION

The golf club head comprises a novel material comprising microscopic bubbles (also referred to as hollow beads) made from a strong, lightweight, low-density material such as glass, ceramic, and/or plastic, mixed with a polymeric material, preferably urethane or silicone, at least partially coating a rear surface of a variable thickness striking face. The presence of the microscopic bubbles in the polymeric material prevents the COR of the golf club head from decreasing by more than 0.10, and more preferably by more than 0.05, when compared with a golf club head having all of the same features and characteristics but which lacks a polymeric fill material completely. The fill material is preferably injection molded onto a back surface of the golf club face to fill variable thickness topography and level the rear surface of the golf club face to allow for the attachment of one or more medallions.

One aspect of the present invention is a golf club head comprising a body comprising a striking face, a sole portion, a top portion, a rear portion, and a cavity, and a fill material comprising a first material and a plurality of microscopic bubbles composed of a second material, wherein the second material is different from the first material, wherein the striking face comprises a nonplanar rear surface, wherein the fill material covers at least a portion of the nonplanar rear surface to create a flat plane, and wherein the plurality of microscopic bubbles constitutes 5% to 70% of a volume of the fill material. In some embodiments, the golf club head further comprises a medallion and an adhesive material, and the medallion is affixed to the flat plane with the adhesive material. In a further embodiment, the medallion may comprise or be composed of the fill material.

In yet another embodiment, the golf club head of claim may further comprise a weight, which may be disposed within the cavity. In a further embodiment, the weight may comprise a tungsten alloy. In a further embodiment, the weight may be at least partially enveloped in a urethane material to form a covered weight, which itself may be at least partially or completely enveloped in the fill material. In an alternative embodiment, a combination of the weight and the fill material may completely fill the cavity. In other embodiments, the golf club head may be an iron-type golf club head, each of the plurality of microscopic bubbles may have a diameter of approximately 18-50 microns, and the first material may have a Poisson's ratio of 0.00-0.50. In still other embodiments, the second material (from which the microscopic bubbles are made) may be selected from the group consisting of glass, ceramic, and plastic.

Another aspect of the present invention is a method comprising the steps of providing a golf club head comprising a variable thickness face component with a striking surface and a rear surface, wherein at least a portion of the rear surface is nonplanar, providing a fill material comprising a polymer material and a plurality of microscopic bubbles composed of a low-density material, providing a medallion sized to cover at least a portion of the rear surface, injecting the fill material onto the rear surface to create a flat surface, and affixing the medallion to the flat surface.

In a further embodiment, the method may comprise the step orienting the face component so that the striking surface is parallel with the ground plane, which step may occur prior to the step of injecting the fill material onto the rear surface to create a flat surface. In yet another embodiment, the step of providing a golf club head may comprise the step of casting the variable thickness face component from a metal alloy material. In yet another embodiment, the plurality of microscopic bubbles may constitute 25-30% of the volume of the fill material, and each of the plurality of microscopic bubbles may have a diameter of approximately 18-50 microns.

In another embodiment, the method may further comprise the step of inserting a weight with a density greater than 4 g/cc into a cavity of the golf club head. In a further embodiment, the method may comprise the step of injection-molding the fill material into the cavity and around at least a portion of the weight.

Having briefly described the present invention, the above and further objects, features, and advantages thereof will be recognized by those skilled in the pertinent art from the following detailed description of the invention when taken in conjunction with the accompanying drawings.

DETAILED DESCRIPTION OF THE INVENTION

The present invention is directed to golf club heads, and particularly iron-type golf club heads, which include a novel fill material comprising a polymeric material and a plurality of microscopic bubbles made of glass, ceramic, and/or plastic, also referred to herein as microscopic, hollow beads. The microscopic bubbles serve two purposes when incorporated with a polymeric material: (1) they lighten the overall fill weight by replacing elastomer with air, thus lowering the material's specific gravity; and (2) they increase the porosity of the fill material, allowing for the formation of micro-holes in the polymeric material. The micro-holes are little air pockets that allow the polymer to flex when the club head impacts a golf ball, thus increasing the COR of the head while at the same time maintaining the sound improvement provided by the polymer itself, such as reduction in dB level and duration. The polymeric material preferably is an elastomer such as polyurethane or silicone having a Poisson's ratio of 0.00-0.50, and more preferably 0.40-0.50, and the microscopic bubbles preferably are measured in D50 micron, which is the median particle size for a measured sample, each microscopic bubble having a diameter of approximately 18-50 microns.

Figure 1:
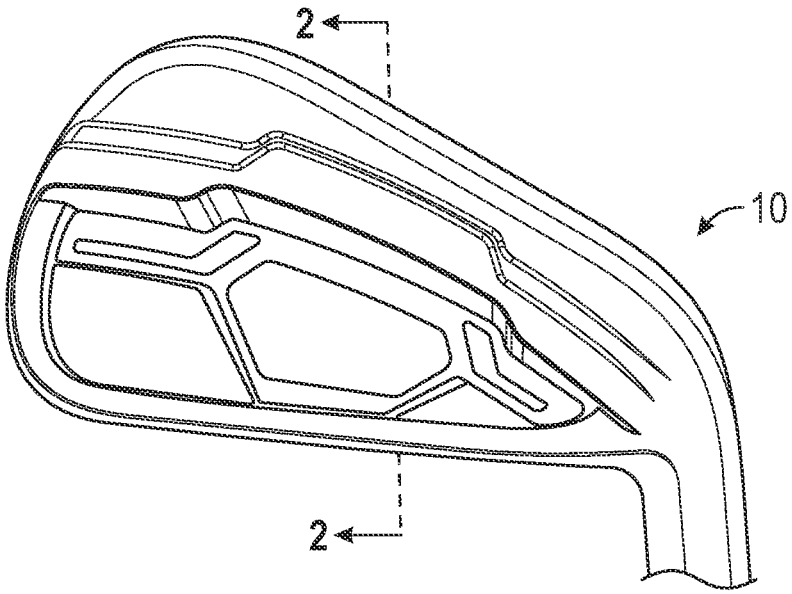
FIG. 1 is a rear elevational view of an iron-type golf club head of the present invention.
Figure 2:
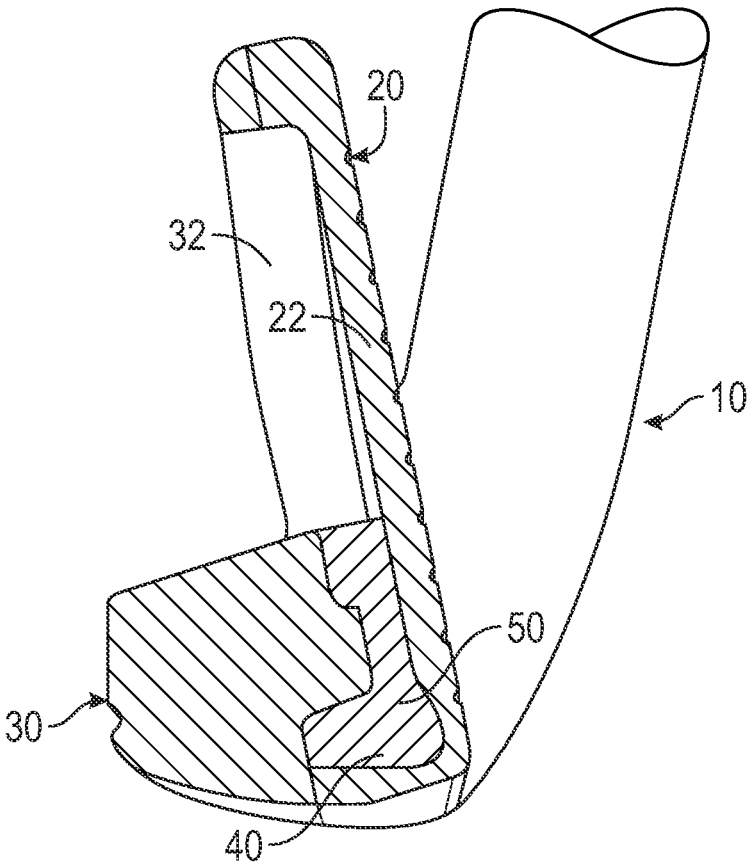
FIG. 2 is a cross-sectional view of the embodiment shown in FIG. 1 along lines 2-2.

A first embodiment of the golf club head is shown in FIGS. 1 and 2. In this embodiment, the golf club head 10 is a cavity back iron having a face cup 20, a body 30, and a cavity 40 between the body and the striking portion 22 of the face cup. The cavity 40 is completely filled with the microscopic bubble fill material 50, which does not extend into the upper cavity portion 32 of the body 30.

Figure 3:
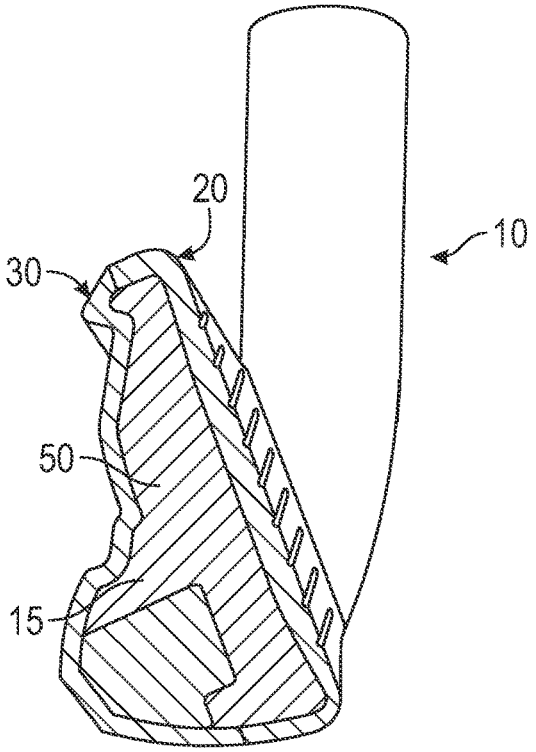
FIG. 3 is a cross-sectional view of a second embodiment of the present invention.

In an alternative embodiment, shown in FIG. 3, the golf club head 10 is a closed cavity back iron with a hollow interior 15, which is completely filled with the microscopic bubble fill material 50.

Figure 4:
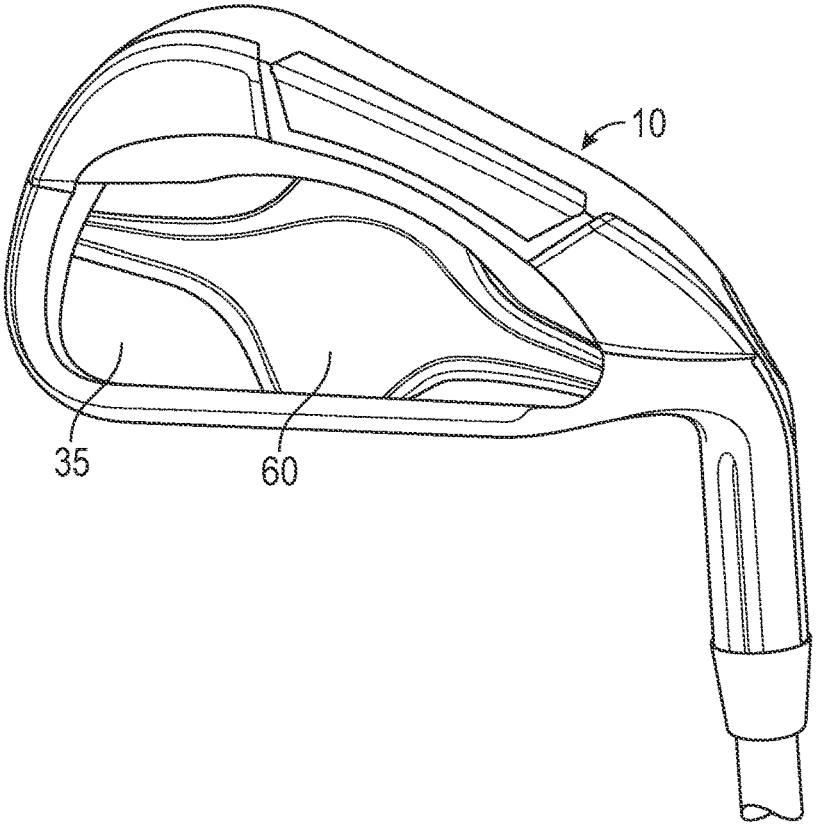
FIG. 4 is a rear elevational view of a third embodiment of the present invention.

In yet another embodiment, shown in FIG. 4, the golf club head 10 has an open cavity back 35 with a medallion 60 molded or otherwise formed from the microscopic bubble fill material 50 affixed to a rear surface 23 of the striking portion 22. When the microscopic bubble fill material 50 is incorporated into a medallion 60, it is preferably placed onto a back side of an electroformed medallion and permitted to cure, and then an adhesive is placed on the fill material and used to bond the medallion 60 onto the club head 10.

In each of the embodiments disclosed herein, the microscopic bubbles in the novel fill material 50 preferably constitute 5% to 70% by volume of the fill material 50, more preferably at least 20% of the volume, and most preferably approximately 25-30% of the fill material's 50 volume.

Figure 5:
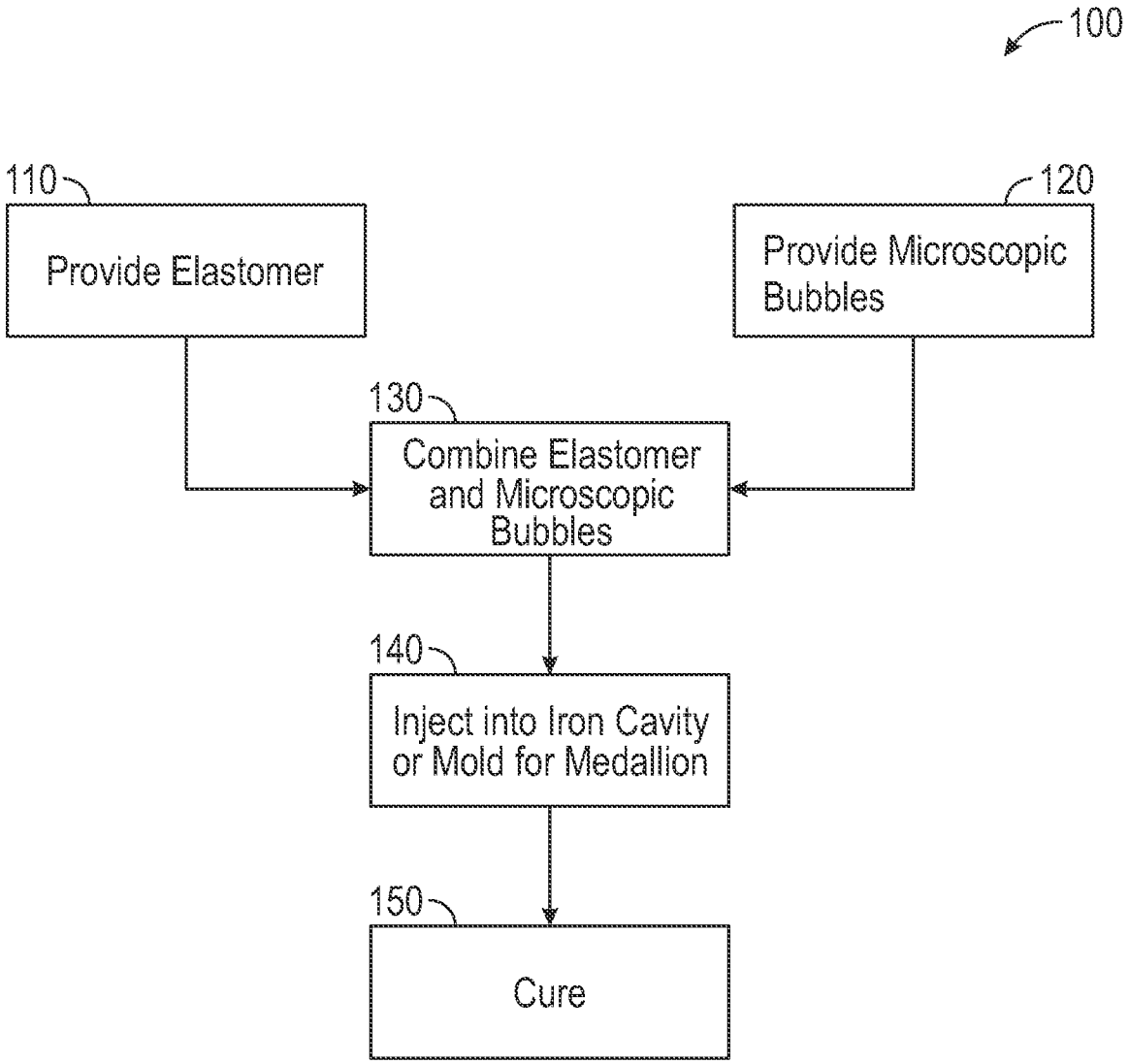
FIG. 5 is a flow chart illustrating a first method of preparing the polymer fill material shown in FIGS. 2-4.

There are several methods of manufacturing the microscopic bubble fill material 50 and incorporating it into the golf club head 10 according to the present invention. The first method 100, shown in FIG. 5, comprises the steps of providing an elastomer material 110 such as polyurethane, providing microscopic bubbles 120, combining the microscopic bubbles with the elastomer material 130 so that the microscopic bubbles form 5-70% of the volume of the resulting mixture, and more preferably approximately 25-30% of the volume of the resulting material, injecting the resulting mixture into a cavity 40 or hollow interior 15 of the golf club head, or a mold for a medallion 140, and then oven curing the mixture or otherwise allowing it to cure 150 (e.g., at air temperature for self-curing materials).

Figure 6:
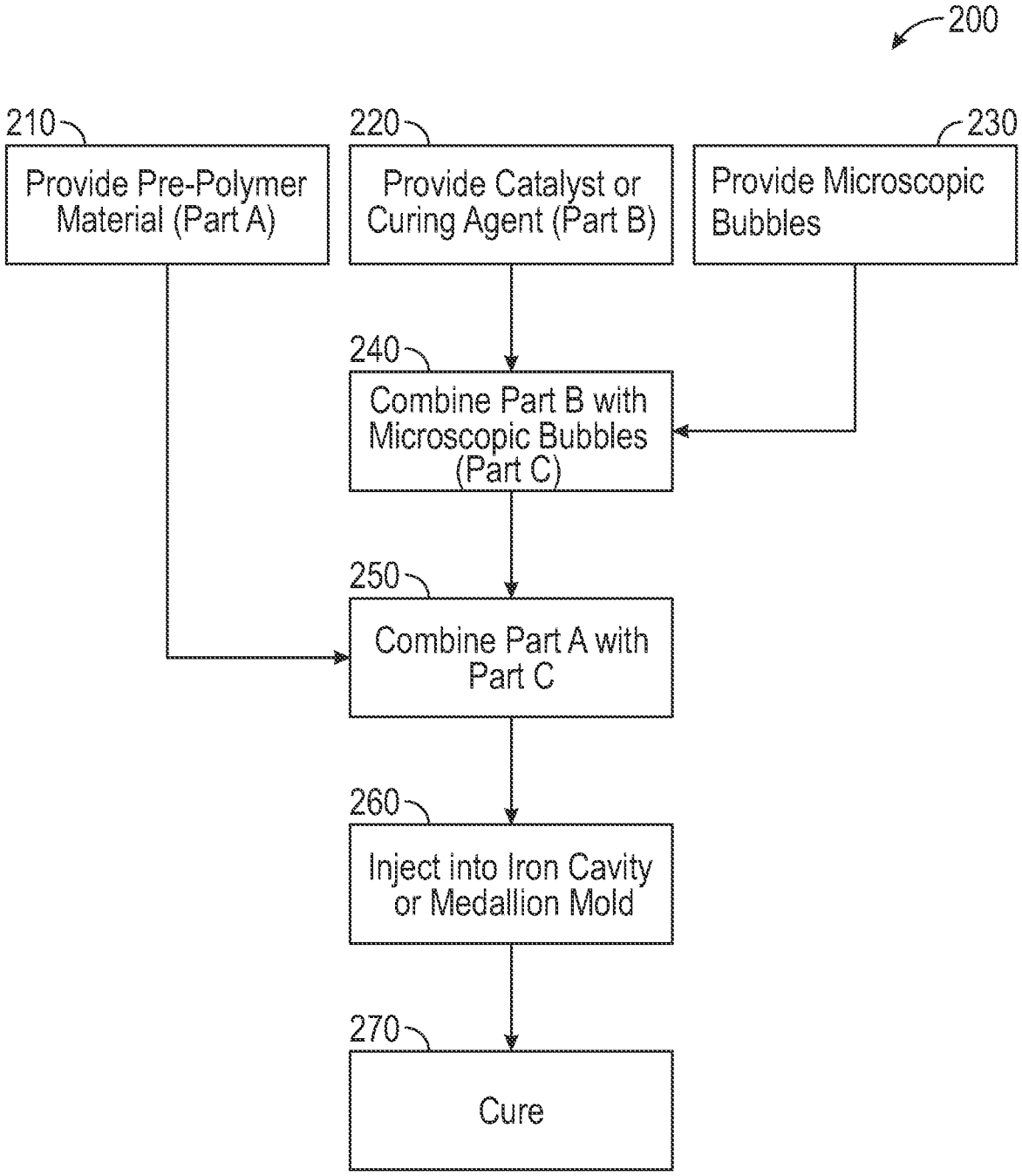
FIG. 6 is a flow chart illustrating a second method of preparing the polymer fill material shown in FIGS. 2-4.

The second, preferred method 200, shown in FIG. 6, comprises the steps of providing a pre-polymer resin (Part A) 210 such as a polyurethane or silicone, providing a curing or catalyst agent (Part B) 220, and providing the microscopic bubbles 230, combining the curing or catalyst agent (Part B) with the microscopic bubbles to form an intermediary material (Part C) 240 that is 5-70% by volume of microscopic bubbles, and more preferably 25-30% by volume, combining the intermediary material (Part C) with the polymer resin (Part A) 250, preferably in a 1:1 Part A to Part B ratio, to form a final mixture, injecting the final mixture into a cavity 40 or hollow interior 15 of the golf club head, or a mold for a medallion 260, and then oven curing the mixture or otherwise allowing it to cure 270. The benefit of this method 200 is that the intermediary material (Part C) can be prepared and placed into storage until a manufacturer is ready to catalyze the pre-polymer resin.

Figure 7:
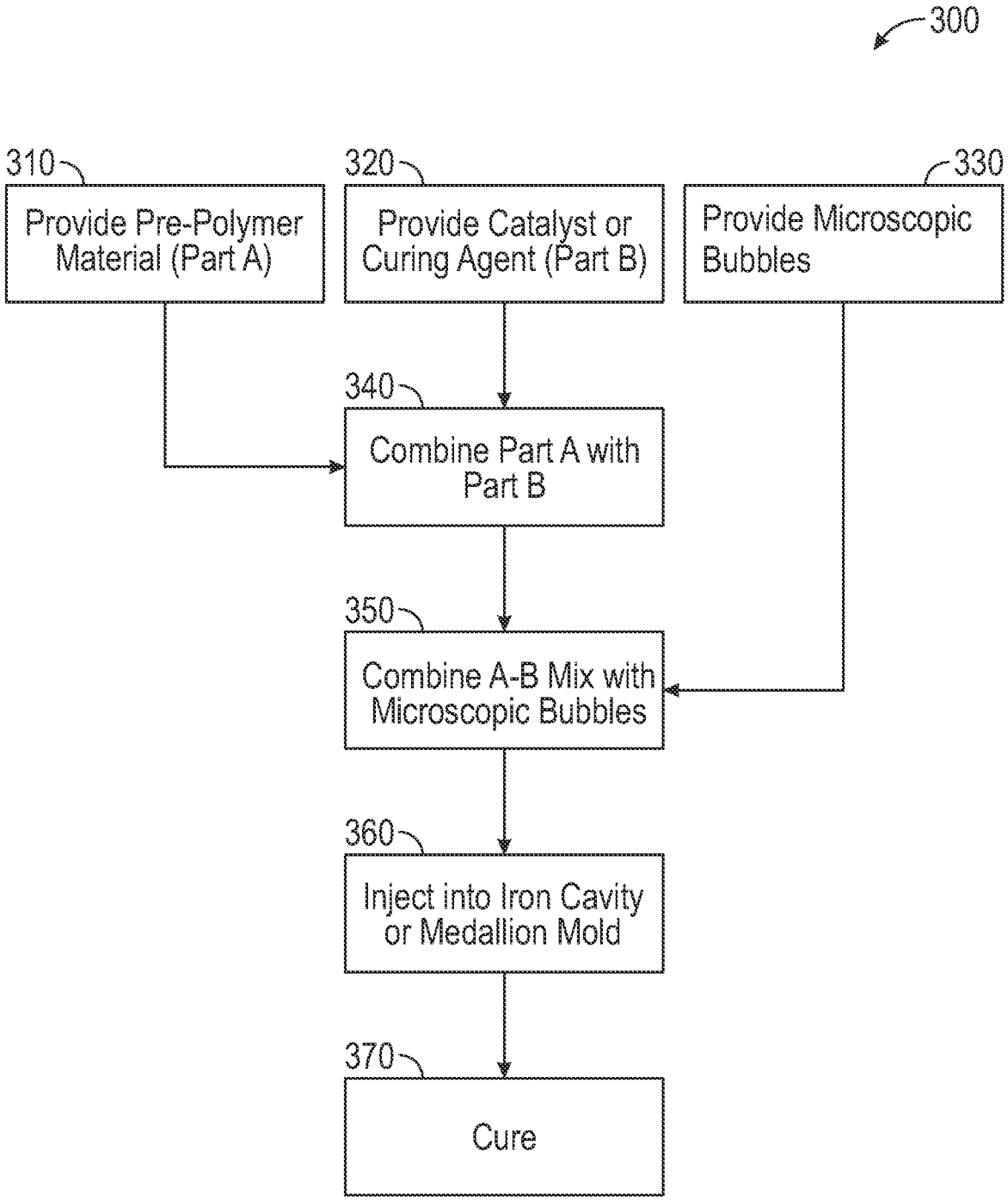
FIG. 7 is a flow chart illustrating a third method of preparing the polymer fill material shown in FIGS. 2-4.

The third method of the present invention is shown in FIG. 7. This method 300 comprises the steps of providing a pre-polymer resin (Part A) 310 (preferably polyurethane or silicone), providing a curing or catalyst agent (Part B) 320, and providing the microscopic bubbles 330, combining the polymer resin (Part A) with the curing or catalyst agent (Part B) 340, preferably in a 1:1 Part A to Part B ratio, to form an intermediary material, combining the intermediary material with microscopic bubbles 350 so that the microscopic bubbles are 5-70% of the volume of the resulting material, and more preferably 25-30% of the volume, injecting the resulting material into a cavity 40 or hollow interior 15 of the golf club head, or a mold for a medallion 360, and then oven curing the mixture or otherwise allowing it to cure 370.

In order to assess the COR performance of the inventive material, test iron-type golf club heads 10 having unfilled (empty) cavities were created and tested, and compared against golf club heads 10 having the same construction and filled with (1) the novel microscopic bubble fill material 50 comprising polyurethane and glass bubbles and made using one of the second 200 and third methods 300 and (2) polyurethane only. As shown in Tables 1 and 2, the polyurethane-only fill significantly lowers the COR of the golf club head 10. In contrast, when a golf club head cavity is filled with the microscopic bubble fill material 50 (glass) of the present invention, the COR decreases, on average, only by 0.04, thereby retaining the performance benefits of an unfilled golf club head 10. This is particularly evident when the microscopic bubbles or hollow microscopic beads constitute approximately 25% or 30% of the volume of the fill material 50, as shown in Table 1.

TABLE 1

| Test Club No. | COR (no fill) | COR (polyurethane only) | Change in COR |
|---|---|---|---|
| 1. | 0.827 | 0.806 | −0.021 |
| 2. | 0.827 | 0.806 | −0.021 |
| 3. | 0.824 | 0.812 | −0.012 |
| 4. | 0.818 | 0.796 | −0.022 |
| 5. | 0.813 | 0.793 | −0.020 |
| | Average change in COR | | −0.019 |
| Test Club No. | COR (no fill) | COR (30% glass bubble fill) | |
| 6. | 0.825 | 0.820 | −0.005 |
| 7. | 0.823 | 0.818 | −0.005 |
| 8. | 0.826 | 0.821 | −0.005 |
| 9. | 0.825 | 0.821 | −0.004 |
| 10. | 0.826 | 0.823 | −0.003 |
| 11. | 0.825 | 0.823 | −0.002 |
| 12. | 0.823 | 0.817 | −0.006 |
| 13. | 0.821 | 0.817 | −0.004 |
| 14. | 0.818 | 0.816 | −0.002 |
| 15. | 0.816 | 0.813 | −0.003 |
| 16. | 0.825 | 0.821 | −0.004 |
| 17. | 0.825 | 0.817 | −0.008 |
| Test Club No. | COR (no fill) | COR (25% glass bubble fill) | |
| 18. | 0.824 | 0.821 | −0.003 |
| 21. | 0.823 | 0.817 | −0.006 |
| | Average change in COR | | −0.004 |

TABLE 2

| Test Club No. | COR (no fill) | COR (polyurethane only) | Change in COR |
|---|---|---|---|
| 1. | 0.813 | 0.793 | −0.20 |
| Test Club No. | COR (no fill) | COR (5% glass bubble fill) | Change in COR |
| 2. | 0.815 | 0.804 | −0.11 |

Figure 8:
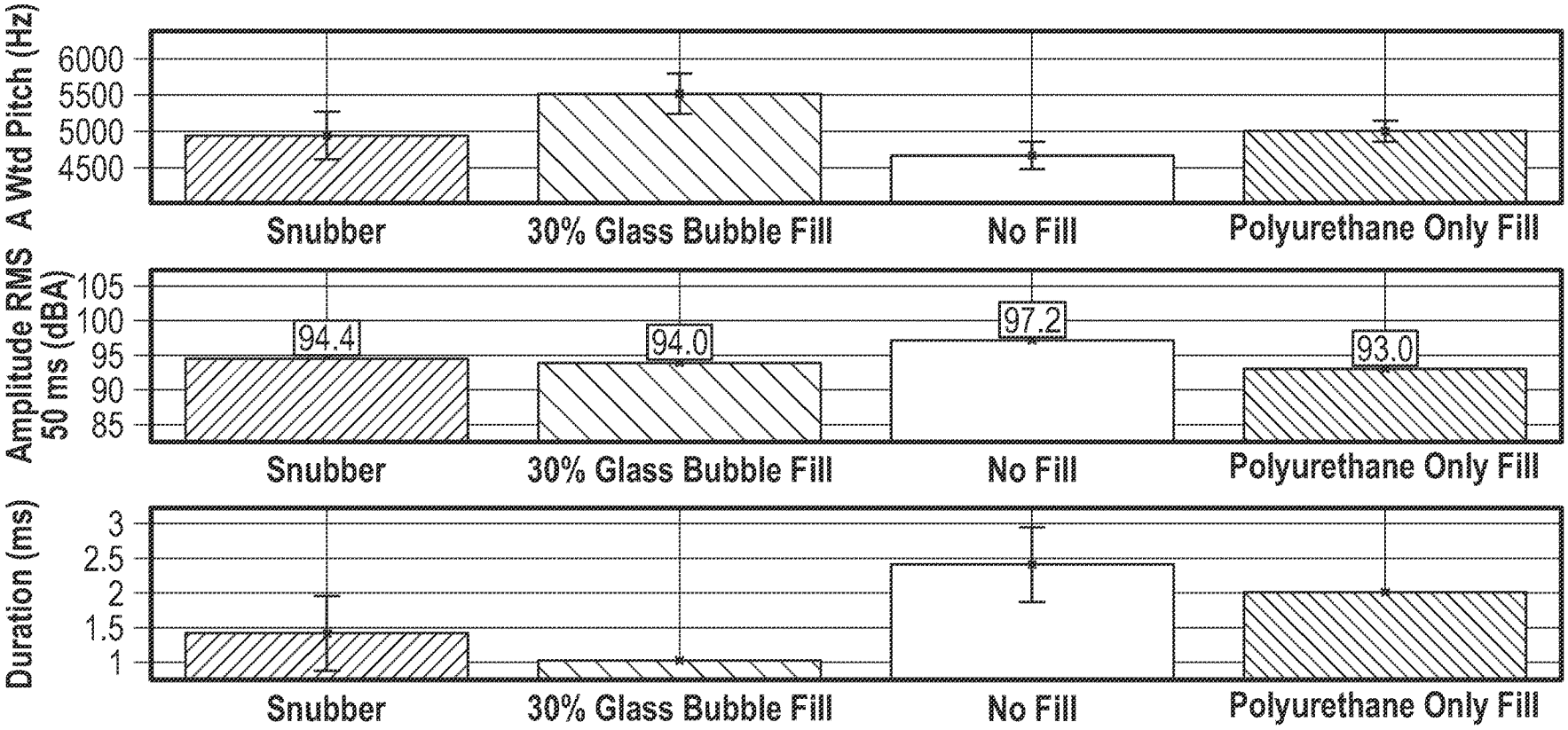
FIGS. 8-9 are charts showing sound measurements of the golf club head shown in FIG. 1 with and without different polymer fill materials and configurations.
Figure 9:
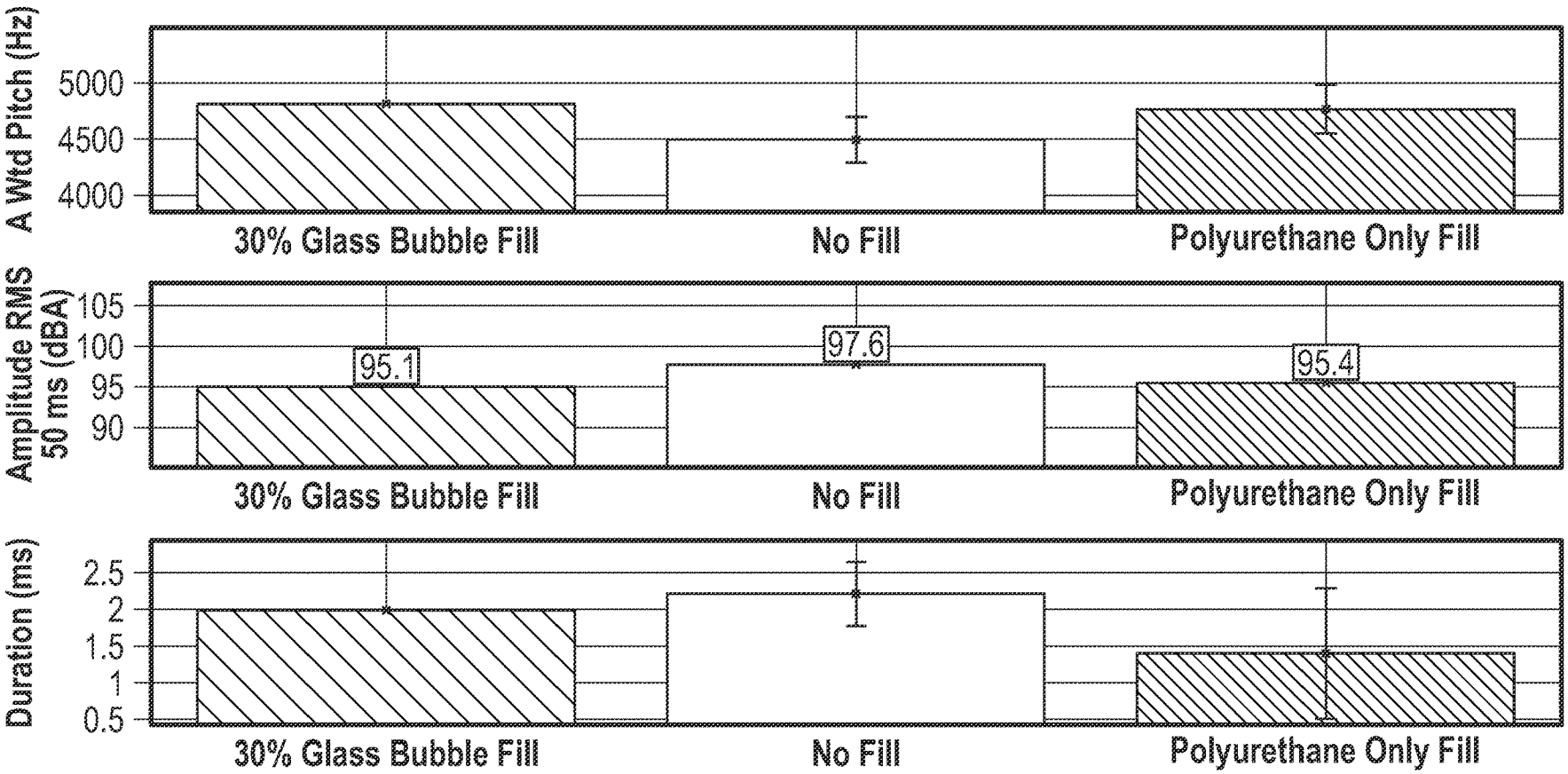

In order to assess sound performance, another group of test golf club heads 10 incorporating the 30% by volume novel microscopic bubble fill material 50 comprising polyurethane and glass bubbles, and made using one of the second 200 and third methods 300 were tested and compared with golf club heads 10 having: (1) the same construction and filled with only polyurethane; (2) no polyurethane filler at all; and (3) a small polyurethane snubber insert. As shown in FIGS. 8 and 9, the 30% by volume microscopic bubble fill material 50 improves the pitch and amplitude of the golf club head 10 upon impact with a golf ball compared to a polyurethane-only fill, thereby improving the overall sound of the golf club head 10. Preferably, a golf club head 10 incorporating the novel fill material has a pitch upon impact with a golf ball of 3000-6000 Hz, and more preferably of 4500-6000 Hz, an amplitude of 90-100 dB, and a duration of 1.0-2.5 ms.

Figure 10:
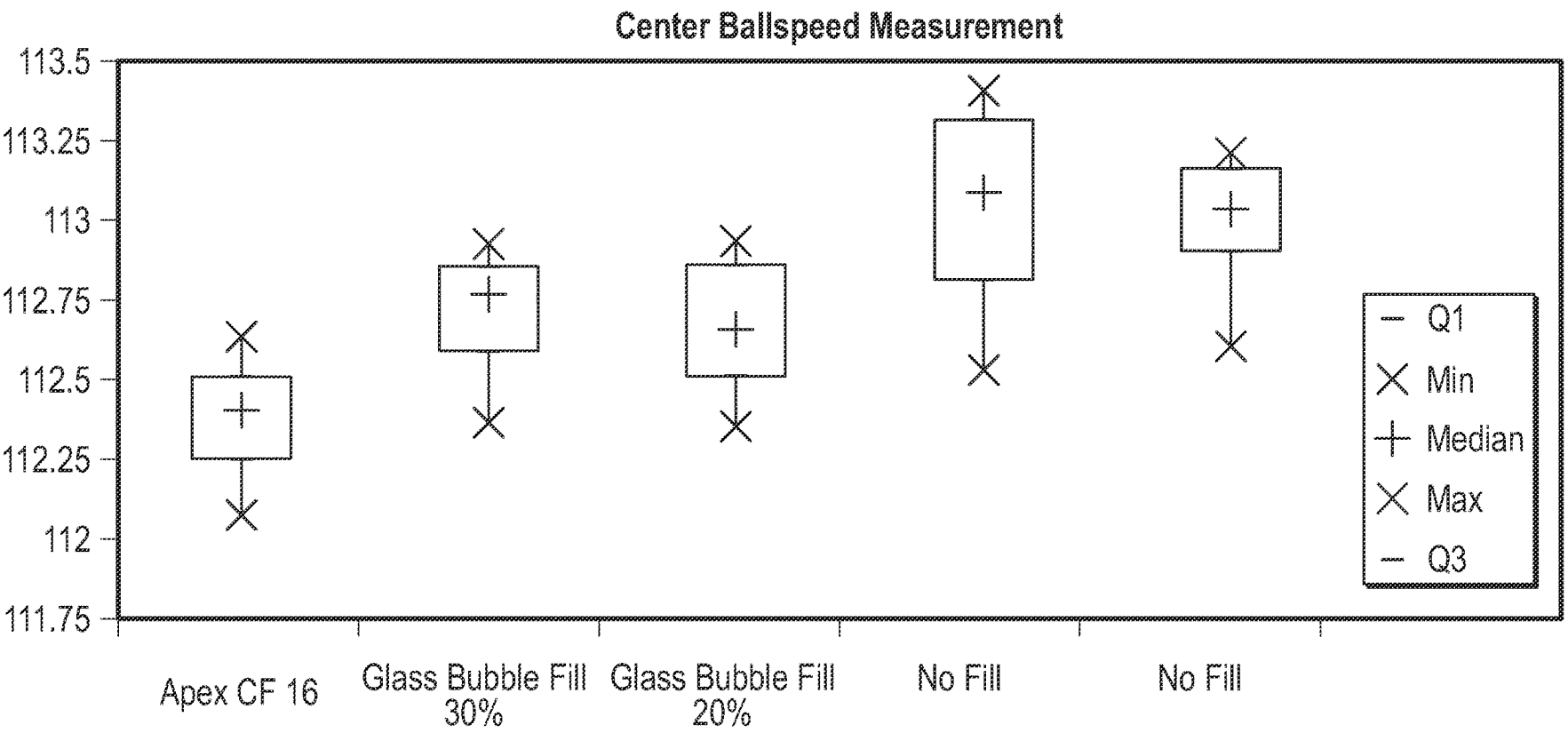
FIG. 10 is a box plot showing ball speed measurements taken from a central area of the face of test 6 iron heads having different polymer fill materials and configurations.
Figure 11:
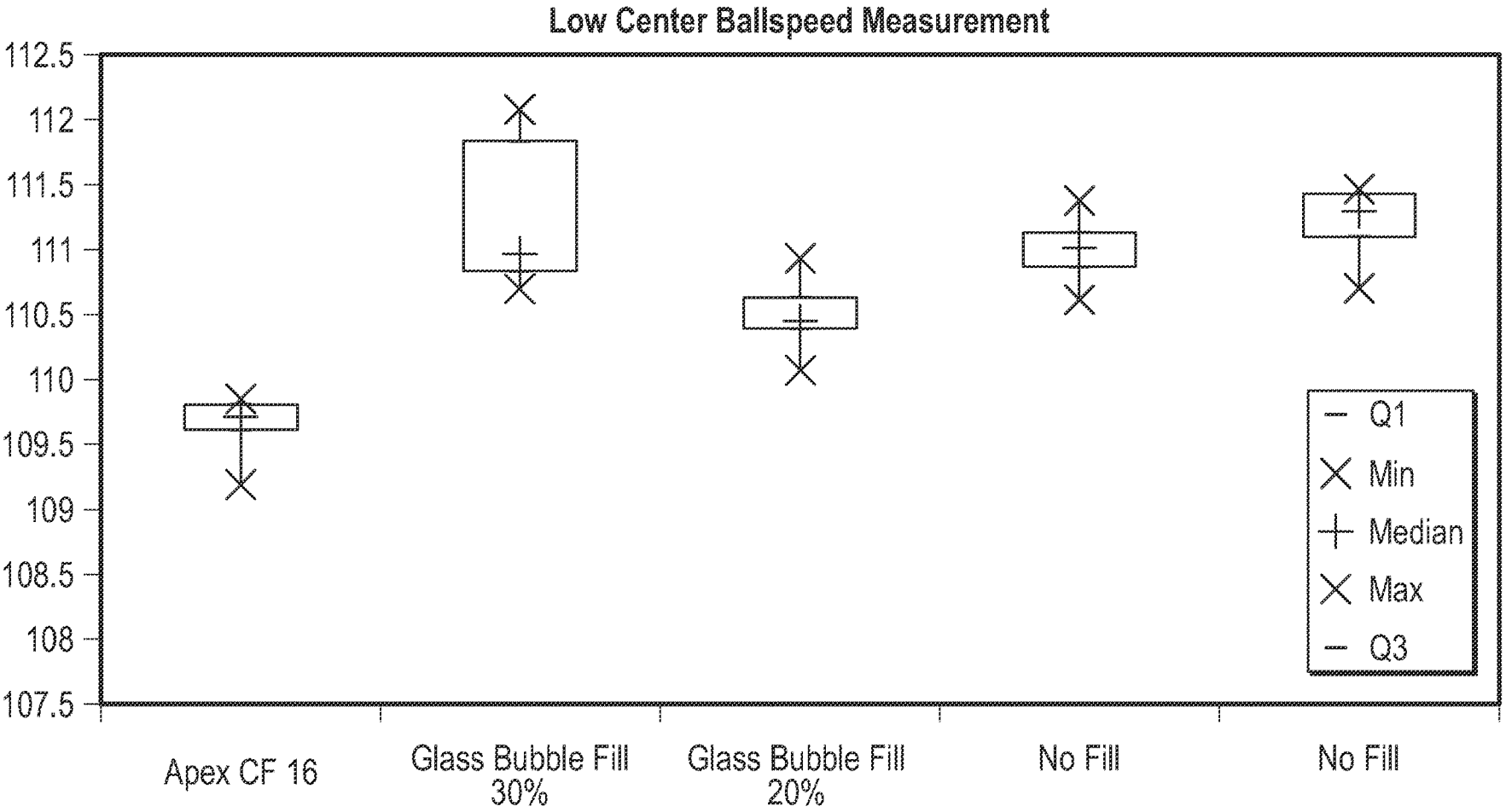
FIG. 11 is a box plot showing ball speed measurements taken from a low-central area of the face of test 6 iron heads having different polymer fill materials and configurations.

To assess the effects of the novel fill material on ball speed performance, the performance of a Callaway Golf Apex CF 16 6-iron comprising a small polymeric snubber was compared with the performance of test 6-irons having no fill, test 6-irons with a fill having 30% by volume microscopic bubbles (glass material), and test 6-irons with a fill having 20% by volume microscopic bubbles (glass material). As shown in FIGS. 10 and 11, the test irons comprising the novel, microscopic bubble fill had a higher median ball speed measured at both the center and low center of the striking face compared with the Apex CF 16 6-iron, and approached or surpassed the ball speed of test clubs lacking a fill material.

Figure 12:
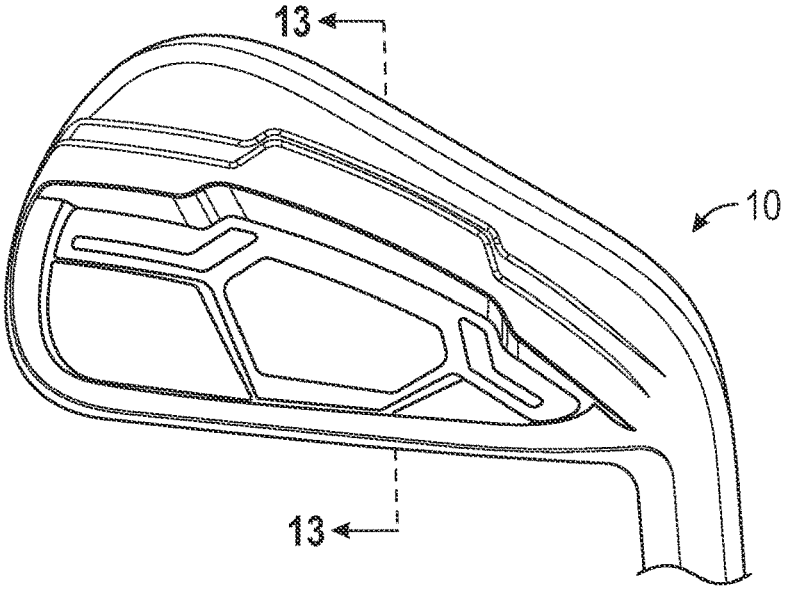
FIG. 12 is a rear elevational view of a fourth embodiment of the present invention.
Figure 13:
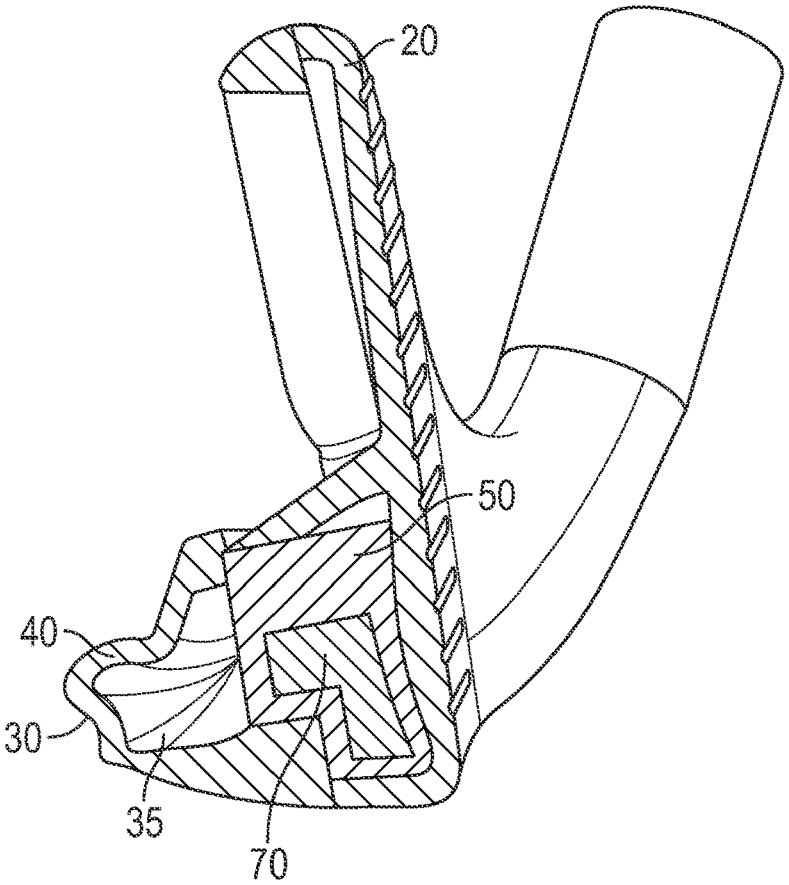
FIG. 13 is a cross-sectional view of the embodiment shown in FIG. 12 along lines 13-13.

In yet another embodiment of the present invention, shown in FIGS. 12 and 13, the golf club head 10 has many of the same features as the embodiments shown in FIGS. 1-3, except that the cavity 40 extends further into a rear portion 35 of the body 30 of the golf club head 10, and the golf club head 10 includes a weight 70 sized to fit within at least a portion of the cavity 40. The weight 70, which preferably is composed of a metal alloy material having a density of 4 g/cc or greater, such as steel or tungsten alloy, is over-molded with the novel fill material 50 of the present invention, which preferably completely envelops the weight 70 and at least partially fills the cavity 40 of the golf club head 10. This embodiment serves to move mass downwards and towards the striking portion 22 of the face cup 20 without compromising the COR of the golf club head 10.

Figure 14:
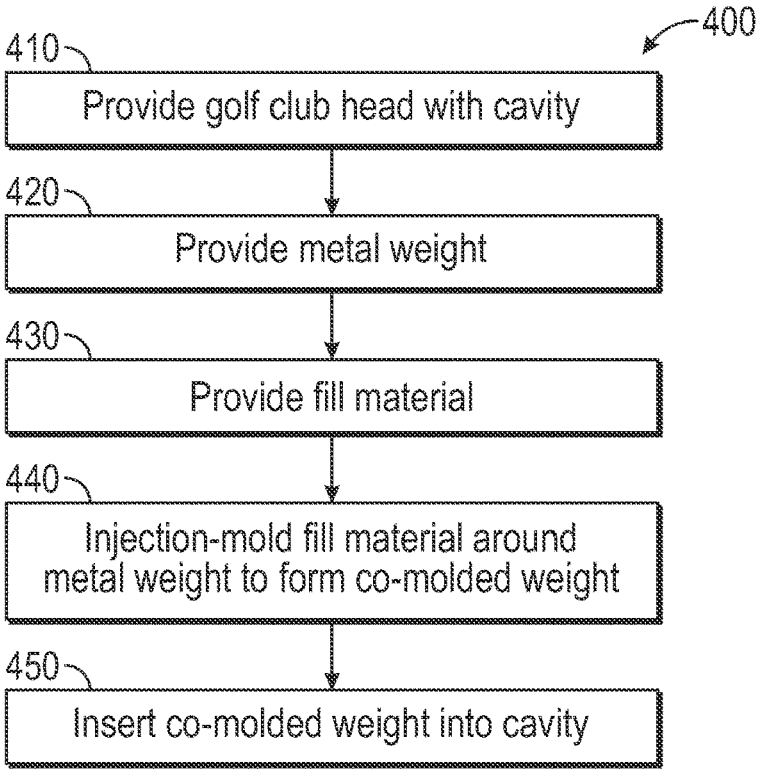
FIG. 14 is a flow chart illustrating a first method of preparing the golf club head shown in FIGS. 12-13.
Figure 15:
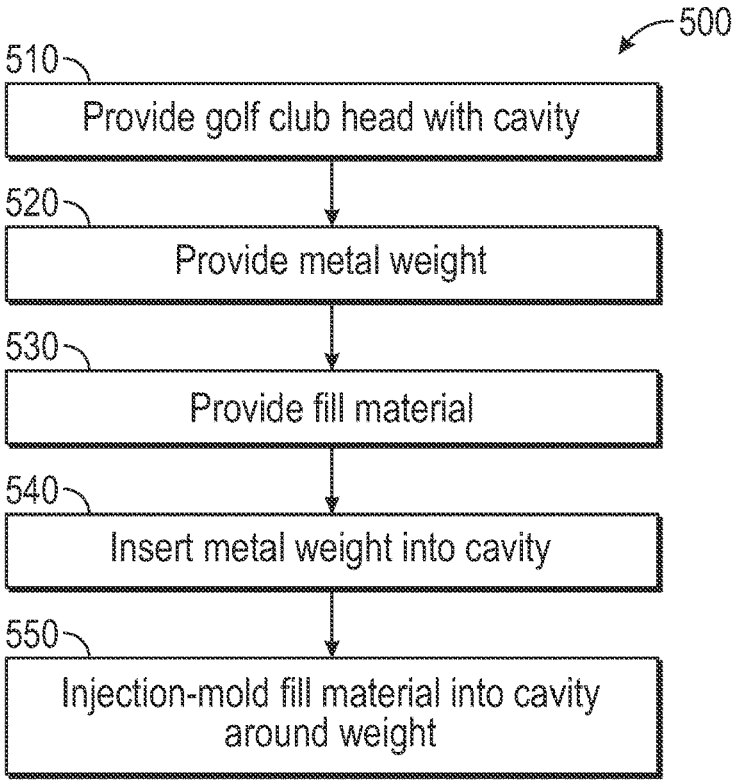
FIG. 15 is a flow chart illustrating a second method of preparing the golf club head shown in FIGS. 12-13.

The embodiment shown in FIGS. 12-13 can be achieved via several methods. A first method 400, shown in FIG. 14, comprises the steps of providing a golf club head comprising a body having a cavity 410, providing a metal weight 420, providing a fill material comprising a polymer material and a plurality of microscopic bubbles composed of a low-density material 430, injection-molding the fill material onto the metal weight to create a co-molded weight 440, and inserting the co-molded weight into the cavity 450. An alternative method 500, shown in FIG. 15, comprises the steps of providing a golf club head comprising a body having a cavity 510, providing a metal weight 520, providing a fill material 50 comprising a polymer material and a plurality of microscopic bubbles composed of a low-density material 530, inserting the metal weight into the cavity 540, and injection-molding the fill material into the cavity and around at least a portion of the metal weight 550. Each of these methods produces a golf club head having a low center of gravity and an optimized COR.

Figure 16:
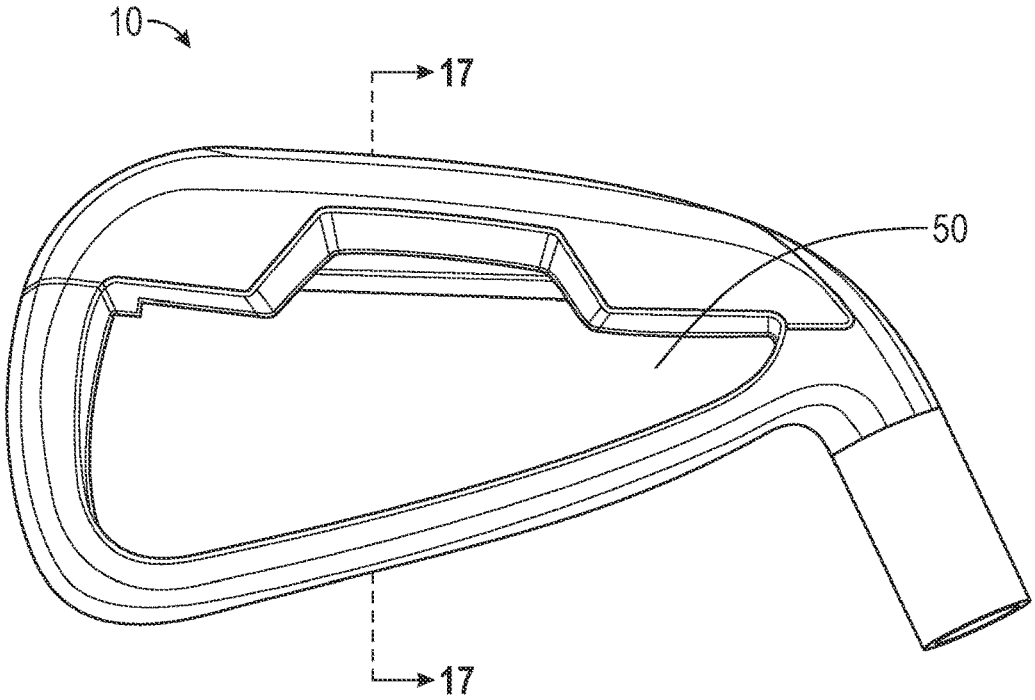
FIG. 16 is a rear elevational view of a fifth embodiment of the present invention.
Figure 17:
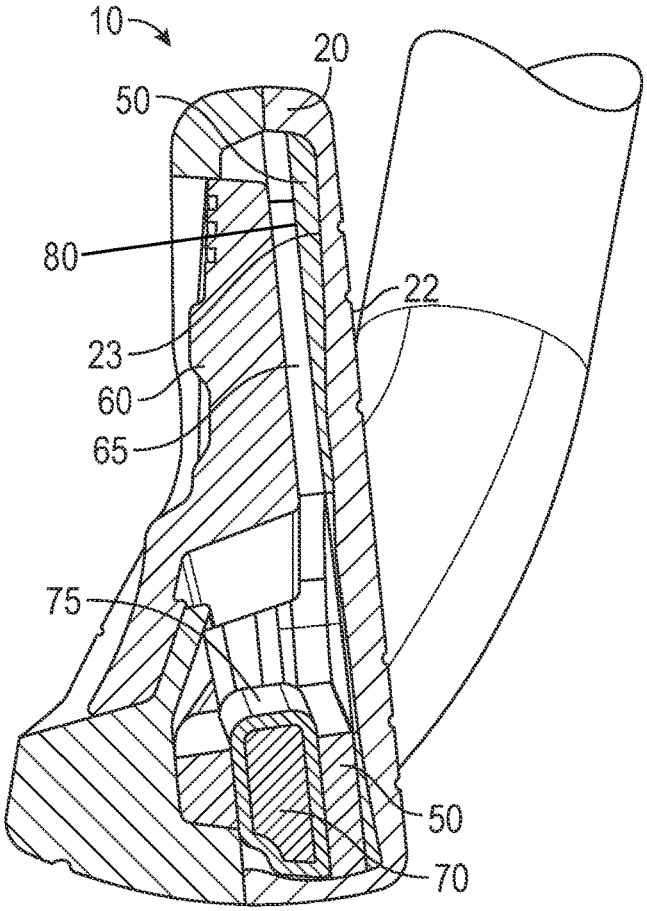
FIG. 17 is a cross-sectional view of the embodiment shown in FIG. 16 along lines 17-17.

In a preferred embodiment, shown in FIGS. 16-17, the face portion 26 of the face cup 20 has a variable thickness, with the striking portion 22 being planar and the rear surface 23 having a topography reflecting the variable thickness pattern. The variable thickness pattern improves the striking performance of the face cup 20, but complicates the process of adding a medallion 60 to the rear surface 23. As shown in FIGS. 16 and 17, the golf club head comprises a thin layer of the fill material 50 coating the rear surface 23, which creates a flat or planar surface 80. The medallion 60 is then affixed to the planar surface 80 with an adhesive material 65. The embodiment shown in FIGS. 16-17 also includes a weight 70, which is enveloped in a first overmold material 75 and is secured within the cavity 40 with the fill material 50 of the present invention. This feature may be provided using the method illustrated in FIG. 15.

Figure 18:
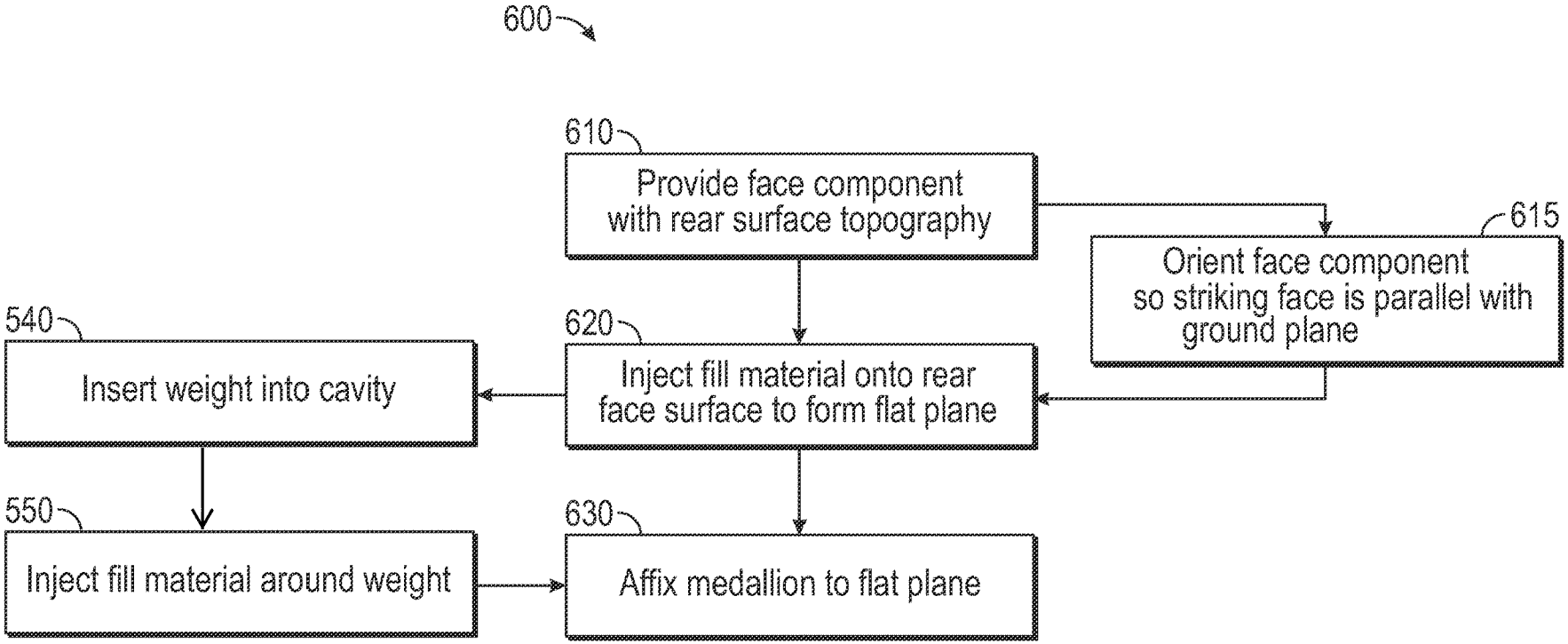
FIG. 18 is a flow chart illustrating a method of preparing the golf club head shown in FIGS. 16-17.

A method of manufacturing the preferred embodiment is illustrated in FIG. 18. This method 600 includes a first step 610 of providing a golf club face component or face cup 20 having a variable thickness striking portion 22 with a rear surface 23 topography; a second step 620 of injecting the fill material 50 onto the rear surface 23 of the striking portion 22 to form a flat, planar surface 80, and a third step 630 of affixing a medallion 60 to the planar surface 80 630. The second step 620 preferably is performed when the face cup 20 is oriented so that the striking portion 22 is parallel with a ground plane, which is illustrated in FIG. 18 as step number 615. In this orientation, the fill material 50 free flows onto the rear surface 23 and becomes self-leveling until the fill material 50 reaches its gel state.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A golf club head comprising:

a body comprising a striking face with a rear surface, a sole portion, a top portion, a rear portion, and a cavity; and a layer covering at least a portion of the rear surface, the layer comprising a first material and a plurality of microscopic bubbles composed of a second material, wherein each bubble of the plurality of microscopic bubbles has a diameter of approximately 18-50 microns.

2. The golf club head of claim 1, further comprising a medallion and an adhesive material, wherein the medallion is affixed to the layer with the adhesive material.

3. The golf club head of claim 2, wherein the medallion comprises the layer.

4. The golf club head of claim 3, wherein the golf club head is an iron-type golf club head.

5. The golf club head of claim 1, further comprising a weight, wherein the weight is disposed within the cavity.

6. The golf club head of claim 5, wherein the weight comprises a tungsten alloy.

7. The golf club head of claim 6, wherein the weight is at least partially enveloped in a urethane material to form a covered weight.

8. The golf club head of claim 7, wherein the covered weight is at least partially enveloped in the layer.

9. The golf club head of claim 8, wherein the covered weight is completely enveloped in the layer.

10. The golf club head of claim 5, wherein a combination of the weight and the layer completely fills the cavity.

11. The golf club head of claim 1, wherein the second material is selected from the group consisting of glass, ceramic, and plastic.

12. The golf club head of claim 1, wherein the first material has a Poisson's ratio of 0.00-0.50.

* * * * *